United States Patent [19]

Hrynewycz

[11] 4,041,430

[45] Aug. 9, 1977

[54] COIL BOBBIN AND MATCHING COVER FOR SOLENOID ASSEMBLY

[75] Inventor: Orest Hrynewycz, Elmwood Park, Ill.

[73] Assignee: Guardian Electric Manufacturing Co., Chicago, Ill.

[21] Appl. No.: 664,870

[22] Filed: Mar. 8, 1976

[51] Int. Cl.[2] ..... H01F 27/02

[52] U.S. Cl. ..... 336/92; 335/278; 336/192; 336/198

[58] Field of Search ..... 336/192, 198, 208, 136, 336/209, 90, 92; 335/278, 296, 260, 261, 262

[56] References Cited

U.S. PATENT DOCUMENTS

| | | | |
|---|---|---|---|
| 3,117,294 | 1/1964 | Muszynski et al. | 336/198 X |
| 3,230,490 | 1/1966 | Johnson | 336/192 X |
| 3,354,417 | 11/1967 | Davis | 336/198 |

FOREIGN PATENT DOCUMENTS

| | | | |
|---|---|---|---|
| 1,351,583 | 12/1963 | France | 336/198 |

*Primary Examiner*—Thomas J. Kozma
*Attorney, Agent, or Firm*—Allegretti, Newitt, Witcoff & McAndrews

[57] ABSTRACT

An improved bobbin and cover assembly for use in the manufacture of an electrical solenoid includes internal centering lugs for the hollow core bobbin which position the solenoid core. Ridges are integrally molded in the end flange of the bobbin and cover for cooperation with a solenoid field assembly to provide insulation of the field assembly from the leads and to provide for centering of the field assembly.

4 Claims, 7 Drawing Figures

COIL BOBBIN AND MATCHING COVER FOR SOLENOID ASSEMBLY

BACKGROUND OF THE INVENTION

This invention relates to a bobbin and cover assembly and, more particularly, to a molded insulating bobbin and cover assembly for use in the manufacture of an electrical solenoid.

Electrical coil assemblies, such as used in transformers, relays, solenoids and indicators, have heretofore been conventionally made by winding a continuous length of insulated magnet wire onto a core piece of a spool or bobbin. The coating on the wire provided insulation between the adjacent turns of the wire. It was found that the insulation was often damaged during manufacture of the electrical coil assembly and that additional insulation was needed for many applications to prevent short circuiting between turns of the wire and between the leads. Thus, it was found expedient to impregnate the formed coil with varnish and then bake the same. For some uses, the varnishing and baking procedures were repeated a second time. Afterwards, insulating tape was affixed about the coil to minimize mechanical damage. This electrical coil assembly manufacturing procedure was obviously slow and relatively expensive.

The electrical coil assemblies are commonly provided with a plurality of conductive terminal lugs on the bobbin, such lugs being secured to the ends of the wire forming the coil. A problem found in such constructions is that the connections of the wire to the lugs cannot inherently be insulated from one another or from other components in the circuit or in the electrical assembly adjacent to the coil without the use of added secondary insulating tapes or the like.

Heretofore, the electrical coil assembly was generally positioned on the support therefor without provision of means to prevent the electrical coil from rotating with respect to the support and for spacing the electrical coil from the support.

U.S Pat. No. 3,230,490 disclosed structure which resolved many of the prior difficulties described. The coil assembly of U.S. Pat. No. 3,230,490 did not, however, lend itself to totally satisfactory utilization as a component for the manufacture of solenoids. For example, the core piece of a solenoid rides in the center tubular member of the disclosed coil assembly. Because of tolerance problems, the core piece tended to bind or alternatively vibrate loosely. To overcome this and additional problems, the improved solenoid coil of the present invention was devised.

SUMMARY OF THE INVENTION

Briefly the present invention of a solenoid coil assembly includes a bobbin and cooperative cover. The hollow center tube of the bobbin includes inwardly projecting lugs for positioning the solenoid core piece. The structure of the bobbin insures centering of the bobbin in the cover. The cover is designed to support terminals which project outwardly. Side ridges at one end of the bobbin and cover cooperate with a solenoid field assembly.

A primary object of the present invention is to overcome the deficiencies and disadvantages of prior solenoid coil constructions by providing a novel molded bobbin and cover assembly.

Yet another object of the present invention is to provide a unique molded bobbin and cover assembly wherein the lead wires for the coils are effectively spaced and insulated from one another and from the solenoid field assembly.

A further object of this invention is to provide a bobbin and cover assembly for an electrical solenoid coil construction which provides superior mechanical protection for the coil and which can be manufactured easily and inexpensively.

A further object of this invention is to provide a bobbin and cover assembly having means for positioning the solenoid core with the bobbin.

These and other objects advantages and features will be set forth in the detailed description which follows.

BRIEF DESCRIPTION OF THE DRAWING

The specific details of a preferred embodiment of the invention and their mode of functioning will be made most manifest and particularly pointed out in clear, concise and exact terms in conjunction with the accompanying drawing, wherein.

DESCRIPTION OF THE PREFERRED EMBODIMENT

Figure 1:
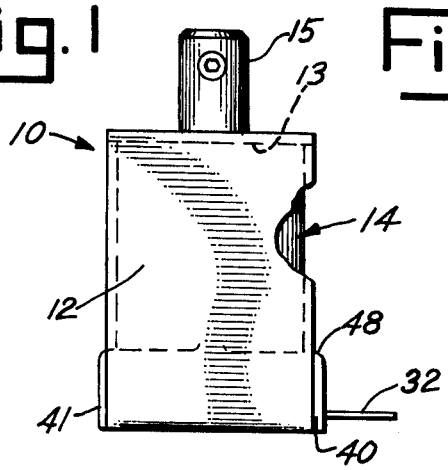
FIG. 1 is a side view of a solenoid assembly utilizing the bobbin and cover assembly of the present invention.

Referring now more particularly to the drawing, like numerals in the various figures will be taken to designate like parts.

In FIG. 1, the invention is illustrated as applied to an alternating current solenoid assembly 10. It will be apparent to those skilled in the art that the principles of the present invention, which are hereinafter more fully described, may be utilized in various types of electrical coil assemblies though the application is particularly directed to solenoids. The assembly 10 comprises a two part field assembly comprised of a field piece 12 and cooperating end plate 13. A molded coil and cover assembly 14 is supported by the field assembly. The molded cover and coil assembly 14 is provided with means for positioning and spacing the molded coil and cover assembly on the field piece and end plate 12, 13. Thus, field piece 12 is a U-shaped member which cradles the cover and coil assembly 14. End plate 13 fits over the assembly 14 and retains assembly 14 in the piece 12. Solenoid core 15 fits within the assembly 14 to complete the solenoid structure.

Figure 2:
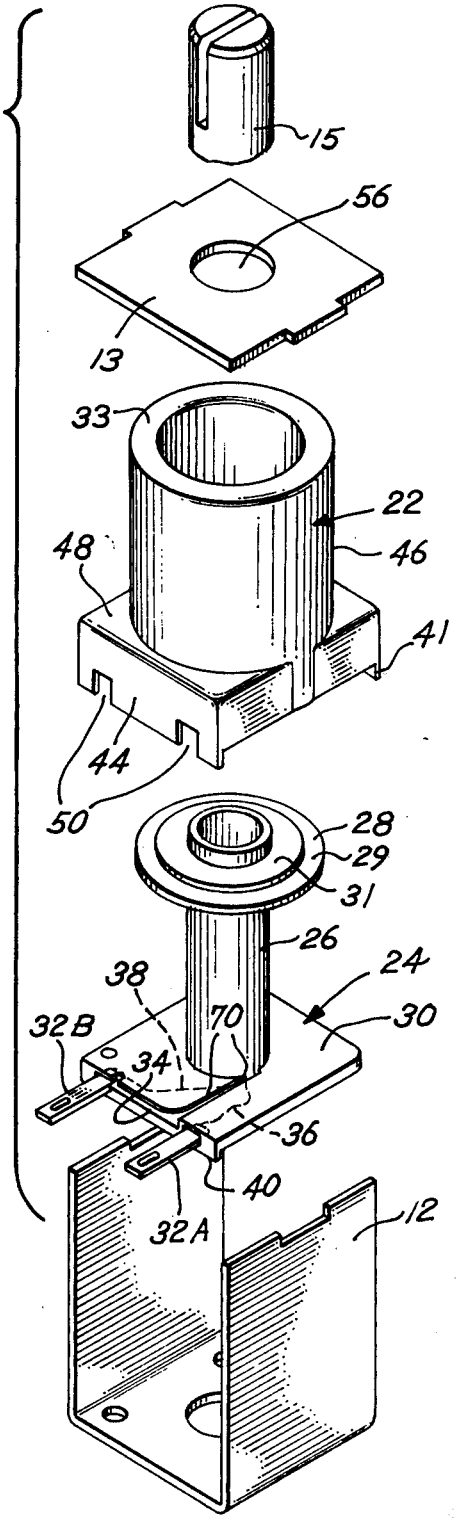
FIG. 2 is an exploded perspective view of the assembly of FIG. 1 with the wire forming the coil being omitted.
Figure 3:
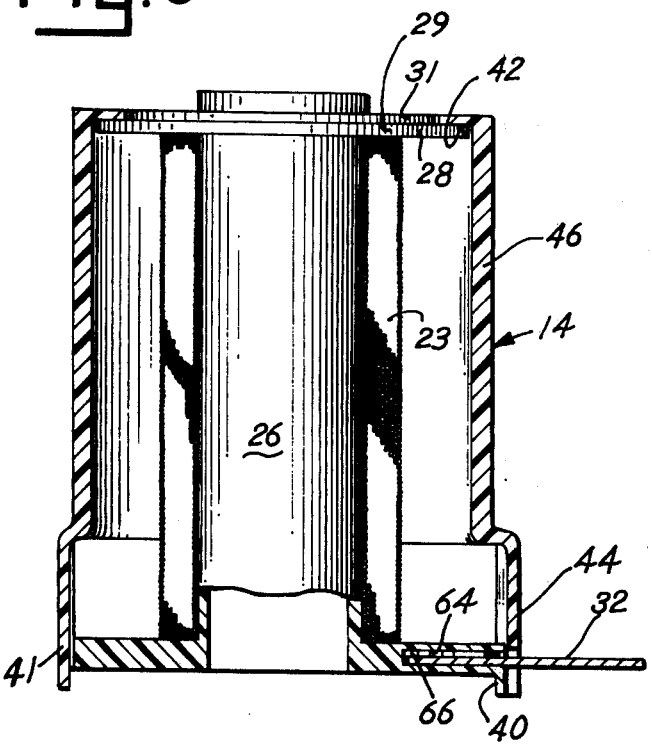
FIG. 3 is a longitudinal cross-sectional view of the bobbin and cover assembly of this invention.

Referring now to FIG. 2, there is illustrated an exploded perspective view of the cover 22 and the bobbin or spool 24 comprising the molded spool and cover assembly 14 along with field piece 12, end plate 13 and core 15. The wire forming a coil 23 in FIG. 3 has been omitted in FIG. 2 for the sake of clarity and the ends of conductive lugs 32A and 32B are shown in the position after the coil 23 has been formed and the leads of the wire forming the coil 23 have been secured to the conductive terminals or lugs 32A, 32B.

The bobbin or spool 24 comprises a central portion or tubular member 26 to which a first generally annular flange 28 and a spaced second flange 30 defining a base are fastened. The member 26 may be cylindrical, as shown, or may take a variety of shapes depending upon the use of the electrical coil assembly, though for use as a solenoid assembly, the cylindrical shape is preferred. Embedded in one end of the second flange 30 are a pair of conductive terminal lugs 32.

Formed in the flange 30, between openings 66 for the conductive terminal lugs 32, in an undercut groove or pocket 34. As is clearly shown in FIG. 2, the undercut groove 34 tapers outwardly from a point adjacent the cylindrical tube 26 to a point adjacent the periphery of the flange 30 between the two conductive terminals 32.

The starting lead of a wire 38 connected to the left terminal lug 32B is positively spaced from the insulated from the terminal lead of wire 36 connected to the right terminal lug 32A. This results since first lead 36 associated with terminal 32A is separated from the second lead 38 by pocket 34 extending from the center of bobbin 22 to terminal 32B.

The outside lower surface of second flange 30 includes a first ridge 40 projecting normally therefrom. Ridge 40 cooperates with the field piece 12 to retain the field assembly in a properly aligned, non rotatable configuration. Ridge 40 is positioned beneath the terminals 32 in order to provide further insulation between the terminals 32 and field piece 12.

Considering now the cover 22, it is seen that the cover 22 comprises an inverted cup-shaped member, which includes an integral annular, disc-like top 42. The cover 22 also includes a tubular portion 46, which is adapted to surround and enclose the flange 28 and the tubular member 26. The cover 22 includes a horizontally extending housing portion 48, which extends from the tubular portion 46, and encloses the second or base flange 30. The cover 22 thus defines an enclosed, insulated chamber. Provided in the sidewall 44 of the horizontally extending housing portion 48 are a pair of spaced slots or openings 50 adapted to receive the outwardly extending portions or legs of conductive terminal lugs 32. The downwardly extending sidewall 44 between openings 50 covers the pocket 34. The housing portion 48 has a generally square cross section to cooperate and fit over the compatibly shaped flange 30. Thus, downwardly extending side wall 41 of housing portion 48 defines a second ridge for cooperation with field piece 12. This structure holds the field piece 12 in fixed orientation relative to assembly 14.

It is also to be noted that the conductive terminal lugs 32A, 32B have a plurality of arrow-like barbs 64 formed on an end thereof, such barbs or serrations being adapted to engage the interior of the opening 66 defined in the base flange 30 for embedding the conductive terminal lugs 32A, 32B in the openings in the second or base flange 30.

The first or top flange 28 of the spool 24 engages the underside 42 of the top 33 of the cover 22 and forms a seal therewith. The tubular member 26 projects outwardly beyond flange 28 and cooperates with opening 56 in end plate 13. The top flange 28 includes an outer recessed portion 29 and an annular inner flange 31 which cooperates with the cover top 33. In this manner, the cover 22 is centered on the bobbin 24.

The spool or bobbin 24 and the cover 22 are preferably molded from a thermoplastic resin or from other resinous materials such as nylon, polyethylene, or a similar material which has good dielectric properties and is easily molded under heat and pressure.

Figure 4:
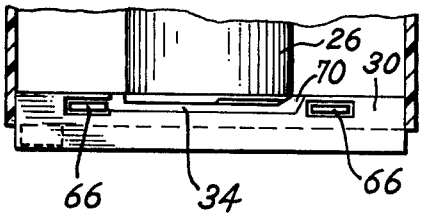
FIG. 4 is a fragmentary detail view of the bobbin and cover assembly with a portion of the cover illustrated in cross section.

Referring to FIG. 4, there is shown a fragmentary cross-sectional view from the front of the cover and bobbin assembly 14. Formed in the end or side of the base flange 30 are a pair of openings 66 which are adapted to receive the conductive terminal lugs 32. Provided between the two openings 66 is an undercut groove or pocket 34 which opens to the top of the base flange 30 through a slot 70.

Figure 5:
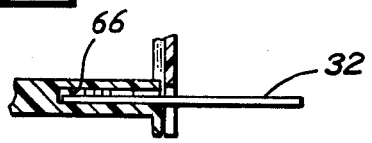
FIG. 5 is a detail view illustrating the initial connection of a conductive terminal lug to an opening in the base flange of the bobbin.
Figure 6:
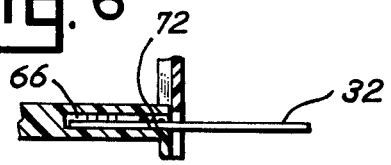
FIG. 6 is a detail view illustrating the connection of the conductive terminal lug in the opening in the base flange of the bobbin after an end of wire forming the coil is secured to the lug and lug is seated in the opening.

Considering now FIG. 5 and FIG. 6, there is illustrated the manner of engaging a conductive terminal lug 32A, 32B in an opening 66 in the base flange 30. Initially, the lug 32 is inserted into the opening 66 until it is approximately adjacent the end of the opening 66. The end 72 of the wire (as wire 36) is then wound about the median portion of the lug 32 and affixed thereto, as for example, by means of a drop of solder. Assuming now that the starting end 72 of the continuous length of wire 38 has been secured to the left-hand lug 32B, as seen in FIG. 2, the wire 38 is inserted through the undercut groove or pocket 34 and wound about the central portion 26 of the spool in the winding space formed between the flanges 28 and 30 to define a coil 23. After the proper number of turns have been wound about the central portion 26, the end 72 of the lead wire 36 is affixed to the median portion of the right-hand terminal lug 32A. After each end of the conductive wires 36, 38 has been affixed to the generally planar terminal lug 32A, 32B as indicated in FIG. 5, the terminal lugs 32A, 32B are forced into the openings 66 until the ends are approximately seated, this movement of the lugs 32 being a distance of approximately 1/32 to 1/16 of an inch. Pushing the conductive terminal lugs 32 inwardly firmly engages the lugs 32A, 32B within the base flange 30 and also provides slack or a loop in wires 36, 38 adjacent the terminal lugs 32A, 32B. This loop is necessary to compensate for contraction and expansion of the continuous length of wire during operation of the electrical coil assembly.

Figure 7:
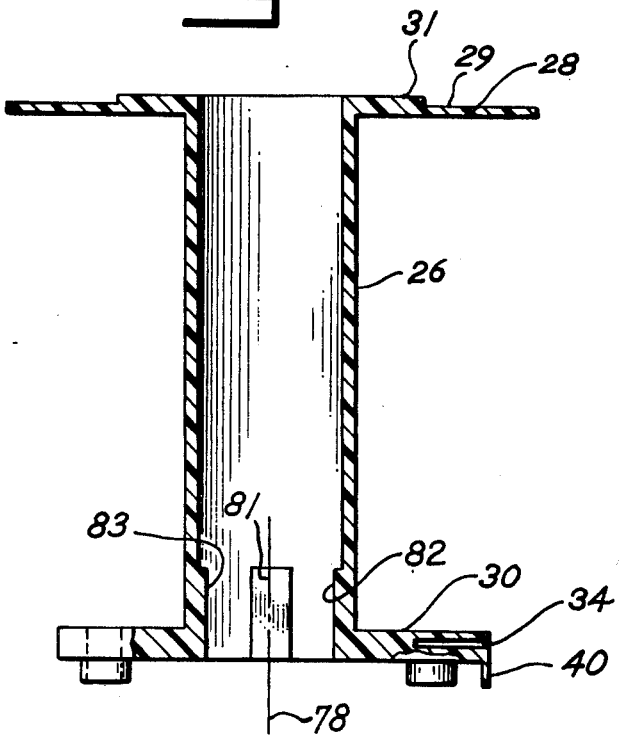
FIG. 7 is a cross-sectional view illustrating the internal lug structure for the bobbin.

FIG. 7 illustrates in greater detail the construction of projections 81, 82 and 83 on the interior of tubular member 26. Each projection 81, 82, 83 is integrally molded in member 26 on the inside surface for centering and holding the core piece 15. Each projection 81-83 comprises a flat plane which defines a chord 78. Thus, a cylindrical core piece 15 will engage the projection along a tangent line generally parallel to the axis of tube 26, for example, tangent line 78. Lugs 81, 82, 83 are also equispaced. Positioning and shape of projections may be varied in accordance with desires.

The cover 22 and the bobbin 24 which are each suitably molded from a resinous material (thermoplastic resins are presently preferred) provide for electrical insulation of the formed coil 23 and also provide for mechanical protection against damage to the coil 23. The present assembly obviates the need for subsequent varnishing and baking of the formed electrical coil assembly as had been required previously.

By this arrangement, there is no crossover of the two leads and, therefore, possible shorting between the two leads of the continuous wire is obviated. Thus, it is evident that by the present invention there has been provided a unique electrical coil solenoid assembly having a molded cover and bobbin which provide an enclosed insulating chamber therebetween and which provide superior protection for the coil, support of the field piece and the solenoid core.

Also, the cover and bobbin assembly for a solenoid, made in accordance with this disclosure, provides superior mechanical protection from exterior damage to the formed coil and is less costly to manufacture. By virtue of the construction of the cover and bobbin assembly from a molded insulated material, there is formed an enclosed, insulated chamber for protecting an electrical coil. The present design assures positive separation between the start and the finish leads and thus shorting between the leads of the coil is obviated. Finally, the structure provides a means for aligning a core piece as well as a field assembly.

The above disclosure has been given by way of illustration and not by way of limitation. It is desired to protect all embodiments of the herein disclosed invention concept within the scope of the appended claims.

What is claimed is:

1. An electrical solenoid assembly comprising in combination: a core piece; a bobbin having first and second spaced flanges, said second flange having a peripheral edge; a hollow tubular portion joining said flanges to define a space, said tubular portion being hollow to receive the solenoid core piece, and including a plurality of inwardly projecting projections on the interior of the hollow tubular portion for supporting the core piece in central position; a wound wire in said space, said wound wire having lead wires extending therefrom, an outwardly projecting shelf on said second flange; an outer end on said shelf; first and second terminal members projecting laterally outwardly from recessed spaced terminal openings in said shelf, a pocket in said second flange passing from one terminal member to said tubular portion, said pocket receiving and insulatingly spacing one lead wire from the remaining portions of said wound wire, said second terminal member receiving the other lead wire, slack provided in said lead wires so as to compensate for expansion and contraction of said wound wire resulting from coil temperature variations, a removable cover member covering said bobbin including said projecting shelf of said second flange and insulatingly covering said bobbin and said wound wire, apertures in said cover for permitting the passage of said terminal members therethrough outwardly from the edge of the second flange, a downwardly extending side portion on said cover member, said downwardly extending side portion covering said pocket forming an enclosed insulated passageway to thereby insulate said other lead from said one lead wire and said wound wire, said downwardly extending side portion of said cover fitting over the edge of the second flange intermediate the terminals, said terminals projecting outwardly through slots in the front portion a first insulating ridge integrally molded in the second flange and extending laterally downwardly from the plane of the second flange adjacent the terminals and normal thereto, said cover including an opening for receipt of a projection of the tubular member from the first flange; a second insulating ridge on the cover member parallel to and spaced from the first ridge; a U shaped field piece which fits between the ridges and cradles the cover and bobbin; and an end plate attached at the open end of the U shaped field piece.

2. The combination of claim 1 wherein the inwardly projecting projections on the interior of the tubular member are uniformly spaced, each projection defining a flat plane in the tubular member, which engages the core piece along a line of tangency.

3. The combination of claim 1 wherein the outside surface of the first flange includes a circumferential recess defining a radial insert cooperative with the opening in the cover to thereby position the bobbin.

4. The combination of claim 1 wherein the tubular member projects from the first flange through a passage in the end plate attached to the field piece.

* * * * *